US005878935A

United States Patent [19]

Furutsu

[11] Patent Number: 5,878,935

[45] Date of Patent: Mar. 9, 1999

[54] APPARATUS FOR ATTACHING TAG PINS

[75] Inventor: Akira Furutsu, Tokyo, Japan

[73] Assignee: Kotec's Co., Ltd., Tokyo, Japan

[21] Appl. No.: 911,918

[22] Filed: Aug. 15, 1997

[30] Foreign Application Priority Data

Aug. 22, 1996 [JP] Japan ..... 8-221173
Sep. 18, 1996 [JP] Japan ..... 8-246574

[51] Int. Cl.[6] ..... B65C 7/00

[52] U.S. Cl. ..... 227/67; 227/136

[58] Field of Search ..... 227/67, 68, 73, 227/74, 135, 136, 138

[56] References Cited

U.S. PATENT DOCUMENTS 5,152,445 10/1992 Furutsu ..... 227/67

5,398,859 3/1995 Lee ..... 227/67

*Primary Examiner*—Stephen F. Gerrity
*Attorney, Agent, or Firm*—Nikaido, Marmelstein, Murray & Oram LLP

[57] ABSTRACT

To provide a tag attaching apparatus including a hollow needle having an expanding slot formed from the front end to the rear end of the needle at its side face in the body of the tag attaching apparatus. A needle cover having a groove for storing the hollow needle at its front and a groove for supporting a tag pin group inserted into a tag pin group guide groove at its back is set to the head of the tag attaching apparatus body enclosed by a transverse groove provided for the tag attaching apparatus body so as to communicate with the expanding slot and a tag pin group guide groove provided for the tag attaching apparatus body so as to intersect the transverse groove so that the needle cover can be vertically pivoted.

9 Claims, 10 Drawing Sheets

APPARATUS FOR ATTACHING TAG PINS

TECHNICAL FIELD

The present invention relates to a tag attaching apparatus for ejecting a tag pin made of synthetic resin from a hollow needle set to the apparatus body to attach a label to a commodity or connect commodities each other by the tag pin.

BACKGROUND ART

During a rest period or at the end of operations, a hollow needle set to a tag attaching apparatus has been covered with a cap so far in order to protect the needle and maintain the safety.

However, it is troublesome to set a cap to a hollow needle because the hollow needle must be inserted into a slit formed on the cap. Moreover, in this case, a person may be injured because the sharp tip of the hollow needle sticks in his finger.

Moreover, most of a group of tag pins inserted into a guide groove of a tag attaching apparatus protrude outward from the back of the tag attaching apparatus at the beginning. Therefore, when inserting a hollow needle into a narrow portion such as the edge of a sleeve in order to attach a label to a commodity, the transverse rod of a tag pin is caught by the commodity and thereby, the tag pin group may not be smoothly fed.

Furthermore, when an operation is continued, a connecting rod from which a tag pin is disconnected comes out of the exit of the guide groove. Because connecting portions for connecting the connecting rod with the tag pin remain on the connecting rod like comb teeth, a commodity is easily caught by them. Moreover, when the commodity is caught, it may be damaged.

Therefore, it is considered to length the head of the tag attaching apparatus body forward so that a tag pin group or a connecting rod does not contact a commodity. In this case, however, the tag attaching apparatus body become very long and thus, it is difficult to use the apparatus.

DISCLOSURE OF THE INVENTION

The present invention is made to solve the above problems and its first object is to provide a tag attaching apparatus whose hollow needle can be quickly and safely stored by a simple operation during a rest period or at the end of operations.

It is another object of the present invention to provide a tag attaching apparatus capable of preventing a tap pin group from contacting a commodity during operations.

It is still another object of the present invention to provide a tag attaching apparatus capable of preventing a connecting rod coming out of the groove guide of the tag attaching apparatus body from contacting a commodity.

That is, the present invention comprises a tag attaching apparatus whose body includes a hollow needle having an expanding slot formed between the front end and the rear end of the needle at its side face, in which a needle cover having a groove for storing the hollow needle at its front and a groove for supporting a tag pin group inserted into a tag-pin-group guide groove at its back is set to the head of the tag attaching apparatus body enclosed by a transverse groove provided for the tag attaching apparatus body so as to communicate with the expanding slot and the tag-pin-group guide groove provided for the tag attaching apparatus body so as to intersect the transverse groove so that the needle cover can be vertically pivoted.

By constituting the present invention as described above, it is possible to quickly and safely store the hollow needle in a hollow-needle storage groove only by rotating the needle cover toward the hollow needle without containing the hollow needle. Moreover, by raising the needle cover toward the upside of the body from the hollow-needle storing position, it is possible to easily support the tag pin group by a tag pin support groove provided for the back of the needle cover. Furthermore, it is possible to prevent the tag pin group from contacting a commodity.

Furthermore, according to the present invention, the needle cover has an arm diagonally set to a partition separating the groove for storing the hollow needle from the groove supporting the tag pin group and a ratchet wheel coaxial with the rotation center of the needle cover, and a stopper engaging with the ratchet wheel is journaled to the tag attaching apparatus body. Therefore, it is possible to easily set the needle cover to a predetermined rotational or setting position.

Furthermore, when the ratchet wheel has a first claw for supporting the needle cover at the hollow-needle storing position, a second groove for supporting the needle cover so that it is kept upright, and a third groove for supporting the needle cover so that it tilts to the rear of the body from its upright position, it is possible to support the needle cover at the hollow-needle storing position, upright position, and the position tilting to the rear of the body.

Furthermore, when a cylindrical connecting-rod guide for guiding the connecting rod to the exit of the tag-pin-group guide groove is included, it is possible to prevent a commodity from being caught by the connecting rod.

Furthermore, the present invention comprises a tag attaching apparatus whose body includes a hollow needle having an expanding slot formed between the front end and the rear end of the needle at its side face, in which a needle cover having a groove for storing the hollow needle at its front is set to the head of the tag attaching apparatus body enclosed by a transverse groove provided for the tag attaching apparatus body so as to communicate with the expanding slot and the tag-pin-group guide groove provided for the tag attaching apparatus body so as to intersect the transverse groove so that the needle cover can be vertically pivoted.

By constituting the present invention as described above, it is possible to quickly and safely cover the hollow needle with the needle cover only by rotating the needle cover toward the hollow needle without contacting the hollow needle. It is also possible to prevent the needle cover from being lost.

Furthermore, when the needle cover has an arm diagonally set to a partition located at the back of the groove for storing the hollow needle and a ratchet wheel coaxial with the rotation center of the needle cover, and a stopper engaging with the ratchet wheel is journaled to the tag attaching apparatus body, it is possible to easily set the needle cover to a predetermined rotational or setting position.

Furthermore, when the ratchet wheel has a first claw for supporting the needle cover to the hollow-needle storing position and a second groove for supporting the needle cover so that it is kept upright, it is possible to support the needle cover at the hollow-needle storing position and upright position.

BEST MODE FOR CARRYING OUT INVENTION

Embodiments of the present invention are described below by referring to the accompanying drawings.

Figure 1:
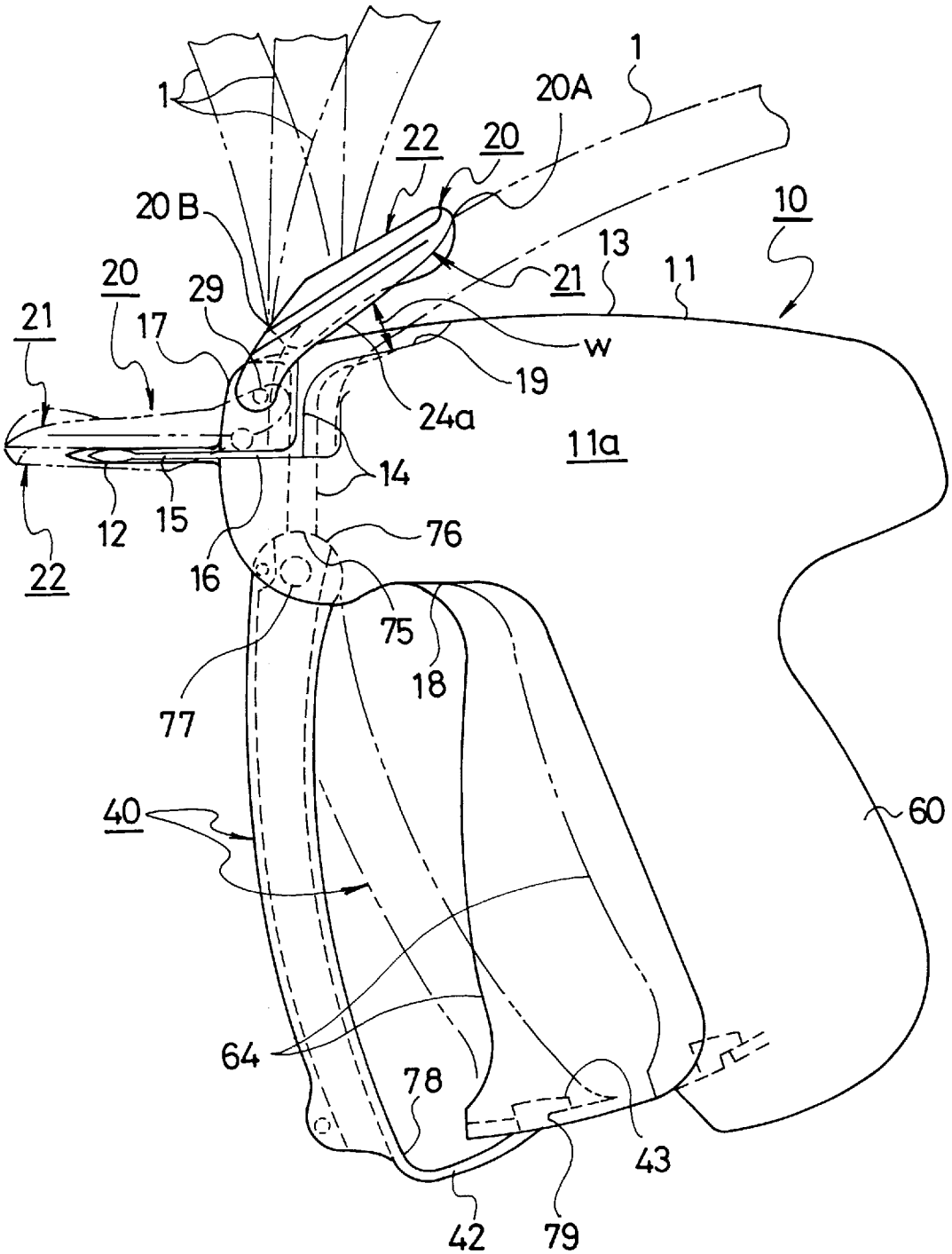
FIG. 1 is a side view showing an embodiment of a tag attaching apparatus of the present invention.

FIG. 1 shows a tag attaching apparatus of the present invention. The tag attaching apparatus 10 has a hollow needle 12 at the front end of a body 11 and is formed like a pistol as a whole. The hollow needle 12 has an expanding slot 15 formed between the front end and rear end of the needle at its side face. Moreover, the body 11 has a guide groove 14 passing through its abdomen 18 from its back 13 and a transverse groove 16 communicating with both the guide groove 14 and the expanding slot 15 at a side face 11*a* of the body.

Figure 3:
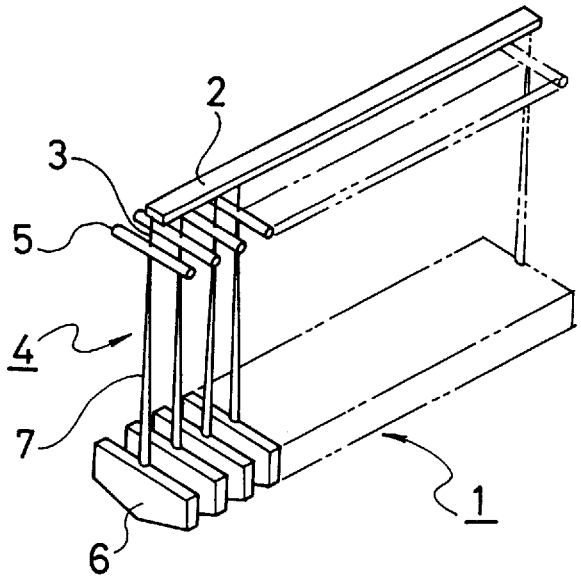
FIG. 3 is a perspective view of a tag pin group.

Then, a tag pin group is first described and then, the internal structure of the tag attaching apparatus 10 is described below. As shown in FIG. 3, a tag pin group 1 is integrally formed with synthetic resin. Moreover, each of many tag pins 4 is connected to a connecting rod 2 through a connective portion 3. Each tag pin 4 has a transverse rod 5 at one end of a slender filament portion 7 and a flat head 6 at the other end of the portion 7. Moreover, the transverse rod 5 of each tag pin 4 is connected to the connective portion 3.

Figure 2:
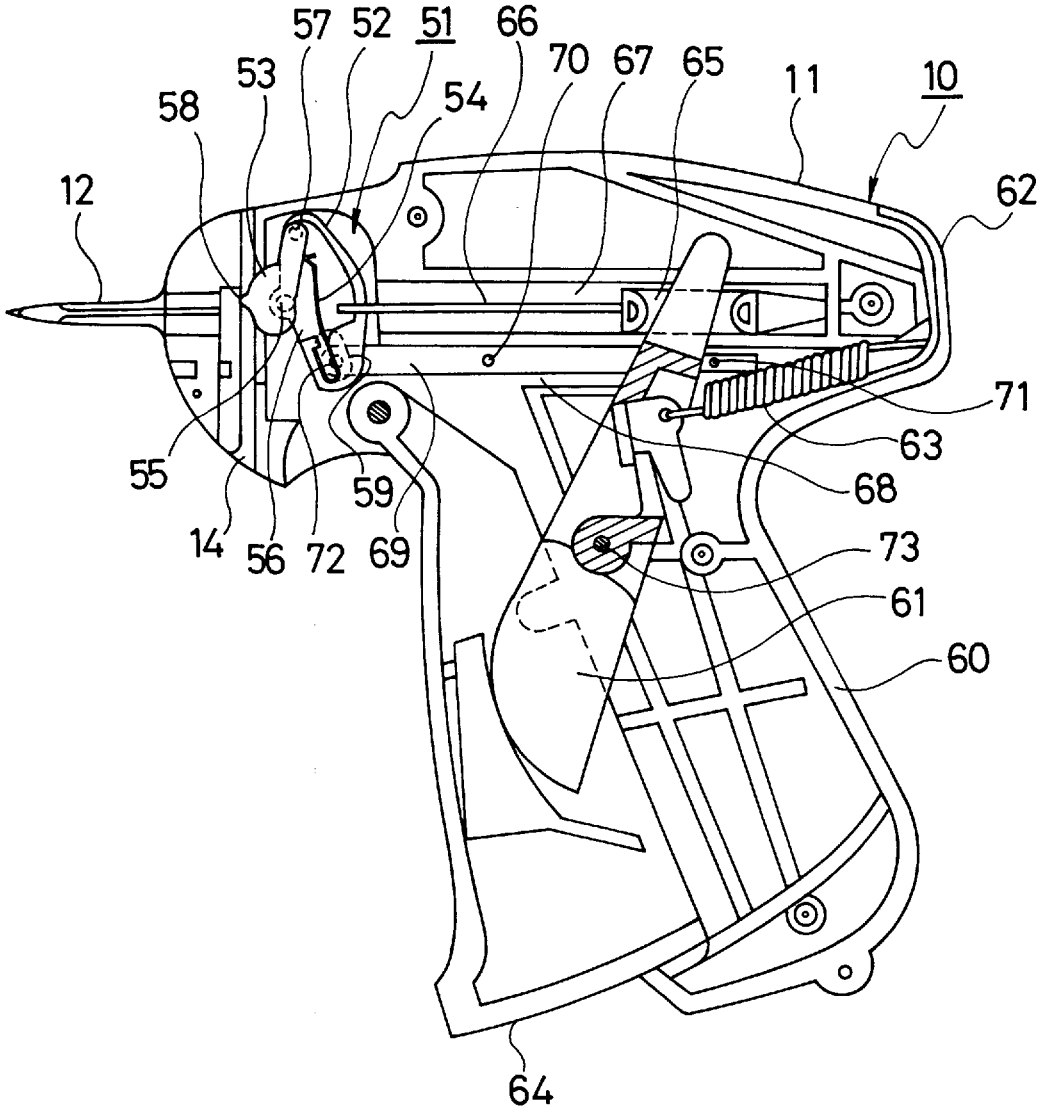
FIG. 2 is an illustration showing the internal structure of a tag attaching apparatus.

Though the tag attaching apparatus 10 has the internal structure shown in FIG. 2, the internal structure of the tag attaching apparatus 10 is not restricted to the structure shown in FIG. 2. In short, it is possible to use any structure as long as the structure can intermittently feed the tag pin group 1 into the guide groove 14. The tag attaching apparatus 10 is provided with feed means 51 behind the guide groove 14 so as to face the groove 14. The feed means 51 has a function for feeding the tag pin group 1 into the guide groove 14 and mainly comprises a support 52, a feed plate 53, and a leaf spring 54.

The support 52 is formed to be almost rhombic or elliptic and rotatably journaled to the body 11. A main shaft 55 for journaling the support 52 to the body 11 is located at the front middle of the support 52 and provided for the back of the support 52. The feed plate 53 is rotatably journaled in a recess 56 located at the upper side of the support 52. A pin 57 for journaling the feed plate 53 to the support 53 is located at the upper end of the feed plate 53 and set to the back of the feed plate 53.

Moreover, the support 52 has ,the leaf spring 54. Furthermore, the feed plate 53 is pressed by the free end of the leaf spring 54 so that a feed claw 58 provided for the front end of the feed plate 53 protrudes toward the front of the body 11.

Though hidden at the back of the feed means 51, a rise prevention claw (now illustrated) engaged with the connective portion 3 of the tag pin group 1 to prevent the tag pin group 1 from rising is set to the gap between the feed means 51 and the body 11.

Moreover, a coil spring 63 is bridged between an intermediate lever 61 journaled to a grip 60 of the body 11 and a buttock 62 of the body 11. Furthermore, a trigger 64 journaled to the body 11 is urged by the coil spring 63 so as to protrude to the front of the body 11 from the grip 60. Furthermore, a slider 65 fitted to the head of the intermediate lever 61 has a piston 66 at its front end.

A second transverse groove 68 is present under a first transverse groove 67 in which the slider 65 is stored and a slide rod 69 is set in the second transverse groove 68. A protrusion 72 provided for the side face of the front end of the slide rod 69 engages with a longitudinal slot 59 formed at the bottom of the support 52. Furthermore, the slide rod 69 has a front protrusion 70 in front of and at the both sides of the intermediate lever 61 and a rear protrusion 71 behind the lever 61. These protrusions 70 and 71 are provided for the side face of the slide rod 69.

Thus, by holding the tag attaching apparatus 10 and pulling the trigger 64, the intermediate lever 61 rotates counterclockwise about a shaft 73 and the piston 66 advances toward the hollow needle 12. Then, a transverse rod (not illustrated) of a tag pin on standby immediately behind the hollow needle 12 is pressed by the piston 66 and protruded outward passing through the hollow needle 12.

As described above, when the intermediate lever 61 rotates counterclockwise, it contacts the front protrusion 70 of the slide rod 69 to advance the slide rod 69. Then, the support 52 of the feed means 51 rotates clockwise about the main shaft 55.

When decreasing the force for pulling the trigger 64, the intermediate lever 61 is rotated clockwise about the shaft 73 by the spring force of the coil spring 63. Moreover, the intermediate lever 61 contacts the rear protrusion 71 of the slide rod 69 to retract the slide rod 69. Then, the support 52 of the feed means 51 rotates counterclockwise. In this case, the feed claw 58 of the feed plate 53 catches the connective portion of a not-illustrated tag pin group and brings the tag pin group into the guide groove 14. Then, a transverse rod (not illustrated) of a tag pin located at the forefront of the tag pin group 1 is on standby immediately behind the hollow needle 12. Moreover, the piston 66 also returns to the initial position in accordance with the return of the intermediate lever 61.

As shown in FIG. 1, the present invention is characterized by journaling the needle cover 20 to the body head 17 enclosed by the guide groove 14 and the transverse groove 16 and located at the upper side of the front end of the body 1 so that the needle cover can be vertically pivoted. The needle cover 20 has a hollow-needle storage groove 22 for storing the hollow needle 12 at its abdomen, that is, at its front and a tag pin group support groove 21 for supporting the tag pin group 1 at its back. Though the length of the needle cover 20 depends on the length of the hollow needle 12, any length is accepted as long as the length allows the hollow needle 12 to be stored and support the tag pin group 1.

Figure 7:
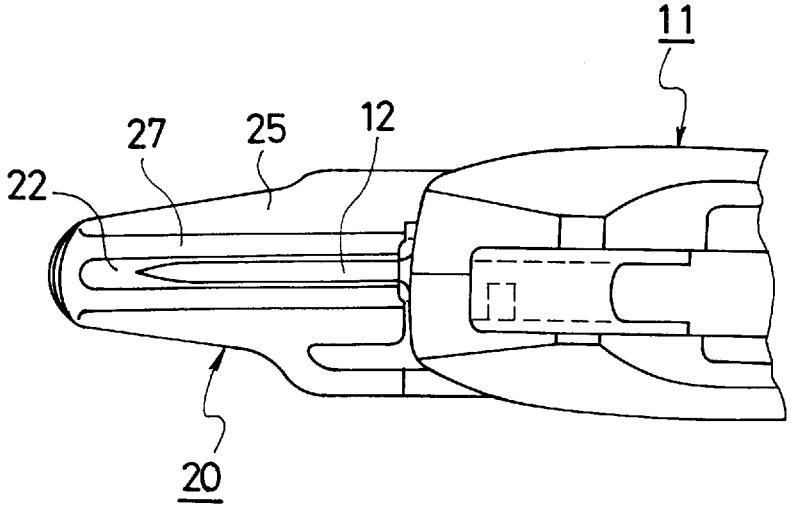
FIG. 7 is an enlarged bottom view of an essential portion of a tag attaching apparatus of the present invention.
Figure 8:
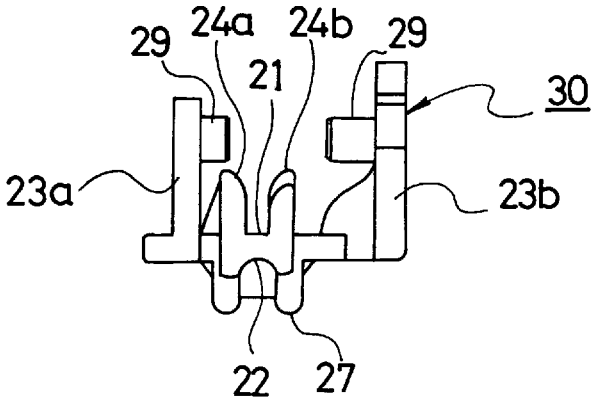
FIG. 8 is a back view of a needle cover.

As shown in FIG. 7, the hollow needle storage groove 22 is formed with a U-shaped side wall 27 provided for the front of a partition 25. The depth of the hollow needle storage groove 22 is enough when it is almost equal to the diameter of the hollow needle 12. However, from the viewpoint of the safety, it is preferable that the depth is approx. 1.5 to 2 times larger than the diameter of the hollow needle 12.

Figure 6:
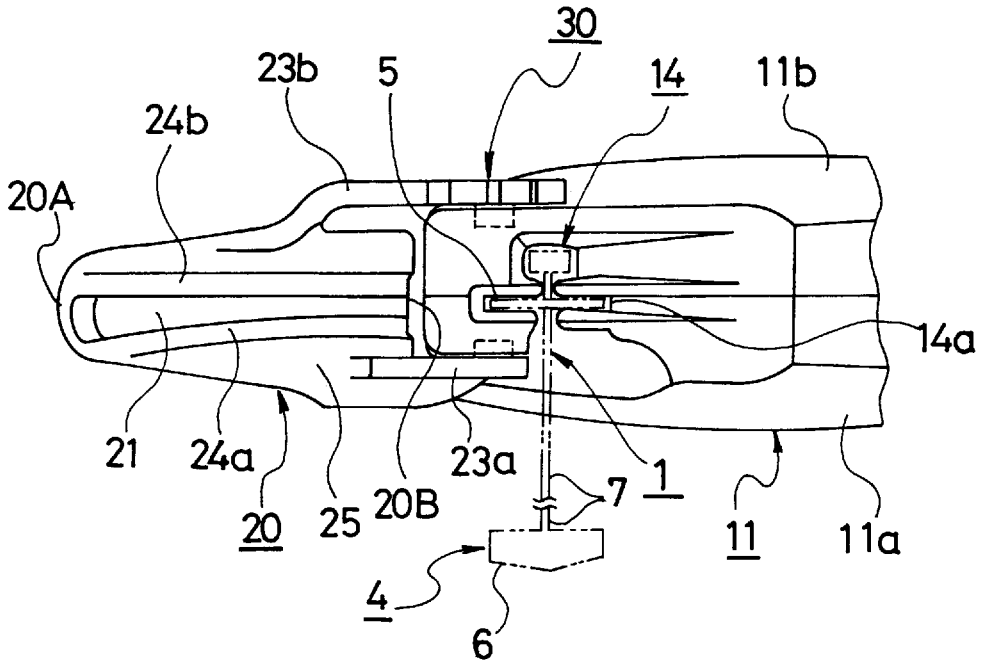
FIG. 6 is an enlarged top view of an essential portion of a tag attaching apparatus of the present invention.

The tag pin group support groove 21, as shown in FIG. 6, is formed with a pair of side walls 24*a* and 24*b* formed at the back of the partition 25. The tag pin group support groove 21 is used to support the tag pin group 1, in other words, the transverse rod 5 of the tap pin 4 and arranged so as to correspond to a transverse groove 14*a* of the guide groove 14 for guiding the transverse rod 5 of the tag pin 4. The case of the tag pin group support groove 21 is formed so that the groove width is gradually decreased toward the rear end 20B from the front end 20A of the needle cover 20. It is preferable that the width of the tag pin group support groove 21 at its narrowest portion is approx. 1.3 to 1.5 times larger than the diameter of the transverse rod 5 of the tag pin 4 in general though depending on the thickness of the rod 5. The transverse rod 5 generally has a diameter of approx. 0.8 to 1.0 mm.

Figure 4:
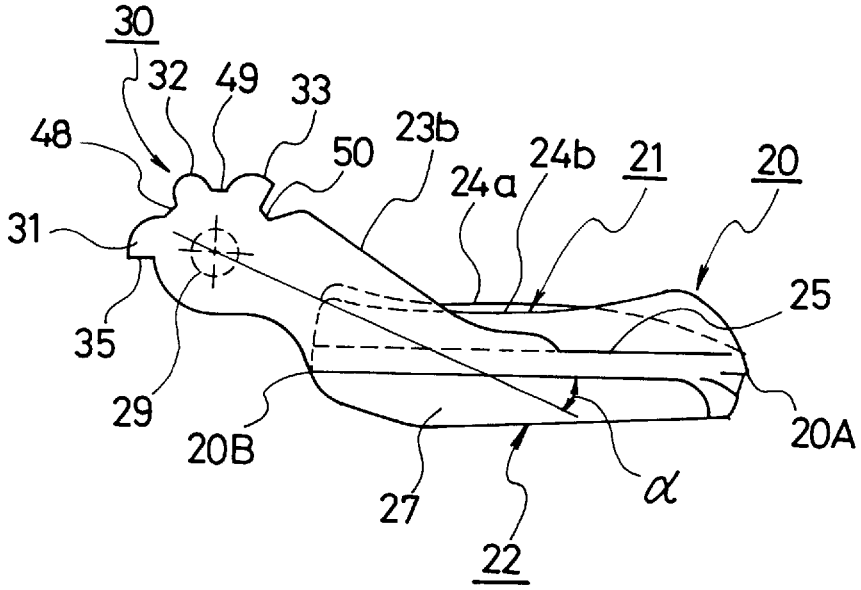
FIG. 4 is a side view of a needle cover.

As shown in FIG. 4, the tag pin group support groove 21 is formed so that the height to one side wall 24*a* from the partition 25 gradually becomes larger than that of the other side wall 24*b* toward the rear end 20B from the front end 20A of the needle cover 20.

Therefore, as shown in FIG. 1, by tilting the needle cover 20 toward the rear of the body 11, an interval w between the side wall 24*a* of the needle cover 20 and the rear margin 19 of the guide groove 14 gradually decreases toward the rear end 20B from the front end 20A of the needle cover 20 and thus, it is possible to securely support the tag pin group 1.

Figure 5:
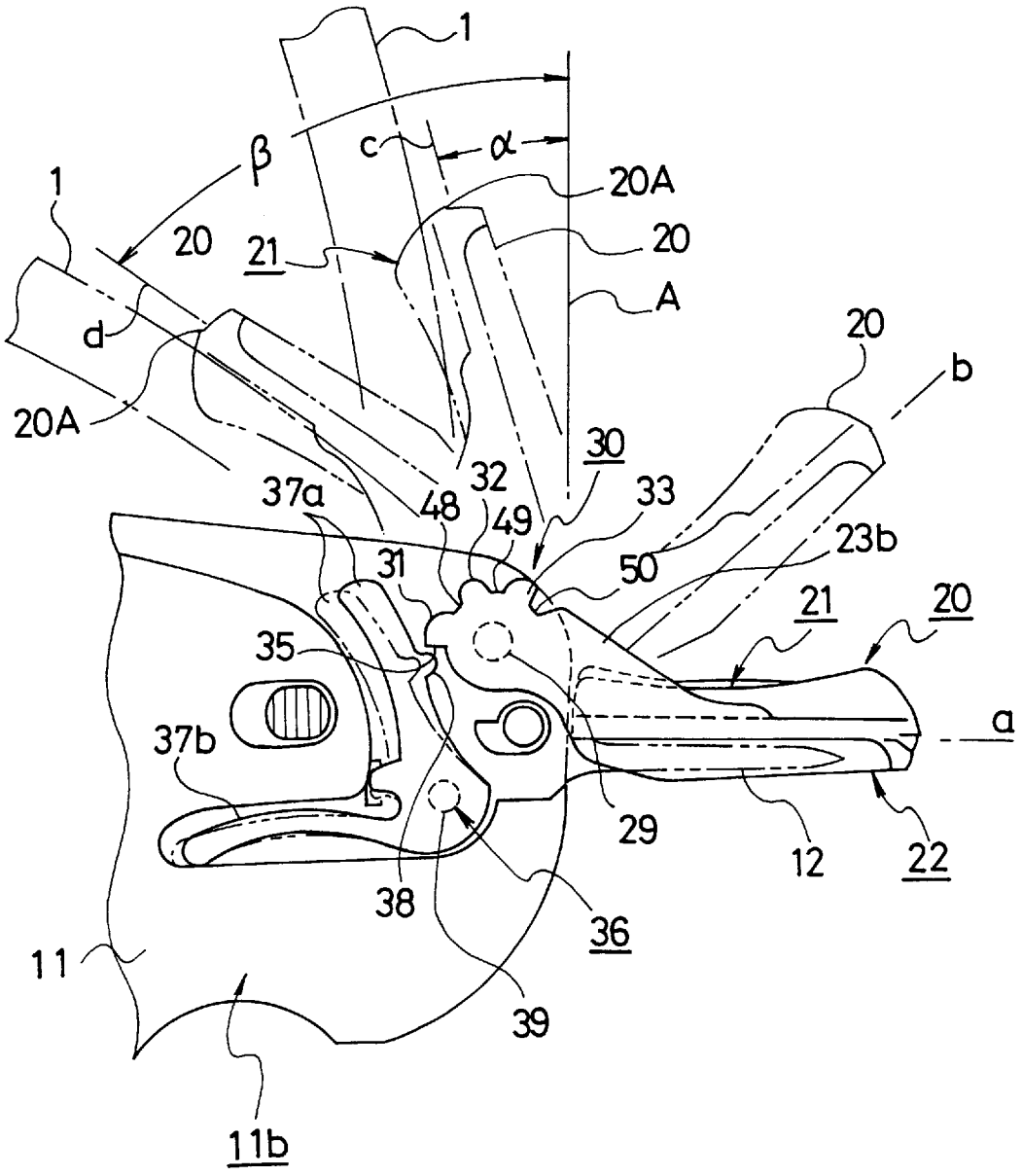
FIG. 5 is an illustration for explaining operations of a needle cover.

Moreover, as shown in FIG. 5, the needle cover 20 has a ratchet wheel 30 coaxial with the shaft 29 at its one arm 23*b*. Moreover, a stopper 36 engaging with the ratchet wheel 30 is journaled to a side face 11*b* of the body 11. The stopper 36 is forked and an arm 37*a* at the side facing the ratchet wheel 30 is provided with a claw 38 engaging with the ratchet wheel 30. Furthermore, the other arm 37*b* is convexly curved upward so as to have a spring force. Furthermore, a shaft 39 to be set to the body 11 is provided for the joint between two arms 37*a* and 37*b*.

As shown in FIG. 4, the ratchet wheel 30 is provided with first, second, and third claws 31, 32, and 33. Moreover, a first groove 48 is set between the first and second claws 31 and 32, a second groove 49 is set between the second and third claws 32 and 33, and a third groove 50 is formed between the third claw 33 and leg 23*b*. Furthermore, the first claw 31 has a notched portion 35 almost parallel with the partition 25 at the partition 25 side of the needle cover 20. The arm 23*b* is set to the partition 25 at a predetermined angle α.

Thus, as shown in FIG. 5, by turning the needle cover 20 to a horizontal position "a", the hollow needle 12 set to the front end of the body 11 is stored in the hollow needle storage groove 22 provided for the front of the needle cover 20. In this case, the claw 38 of the stopper 36 engages with the notched portion 35 of the claw 30 to prevent the needle cover 20 from rotating.

When inserting the tag pin group 1 into the guide groove 14 of the tag attaching apparatus 10 or removing the tag pin group 1 from the tag attaching apparatus 10, the needle cover 20 is rotated to the position of symbol "b". In this case, the arm 37*a* of the stopper 36 is retracted from the position shown by a solid line to the position shown by a two-dot-chain line and the claw 38 of the stopper 36 is removed from the notched portion 35 of the ratchet wheel 30 to rotate the needle cover 20 to the position of symbol "b". When the claw 38 of the stopper 36 engages with the first groove 48 of the claw 30, the needle cover 20 is set to the position of symbol "b".

When the tag pin group 1 set to the guide groove 14 of the tag attaching apparatus 10 is short, the needle cover 20 is rotated to the position of symbol "c". Then, the tag pin group 1 is supported by the tag pin group support groove 21 provided for the back of the needle cover 20 and bent toward the rear of the body 11 as shown by a one-dot-chain line. In this case, because the front end 20A of the needle cover 20 tilts by an angle α from a vertical plane A vertical to the hollow needle 12 toward the rear of the body 11, the tag pin group 1 supported by the tag pin group support groove 21 of the needle cover 20 does not easily contact a commodity. In this case, the claw 38 of the stopper 36 engages with the second groove 49 of the ratchet wheel 30.

When the tag pin group 1 is long, the front end of the needle cover 20 is rotated to the position of symbol "d". Then, because the front end 20A of the needle cover 20 tilts by an angle β from the vertical plane A toward the rear of the body 11, the tag pin group 1 supported by the tag pin group support groove 21 of the needle cover 20 is curved as shown by a two-dot-chain line. In this case, the claw 38 of the stopper 36 engages with the third groove 50 of the ratchet wheel 30.

When the needle cover 20 is rotated from the position of symbol "b" to the position of symbol "c" or "d" or from the position of symbol "d" to the position of symbol "c", "b", or "a", it can be easily rotated counterclockwise or clockwise because the shape of claws of the ratchet wheel 30 is smooth. Moreover, it is preferable to set the angle α in a range of approx. 5° to 10°. Furthermore, it is preferable to set the angle β in a range of approx. 50° to 60°.

Figure 9:
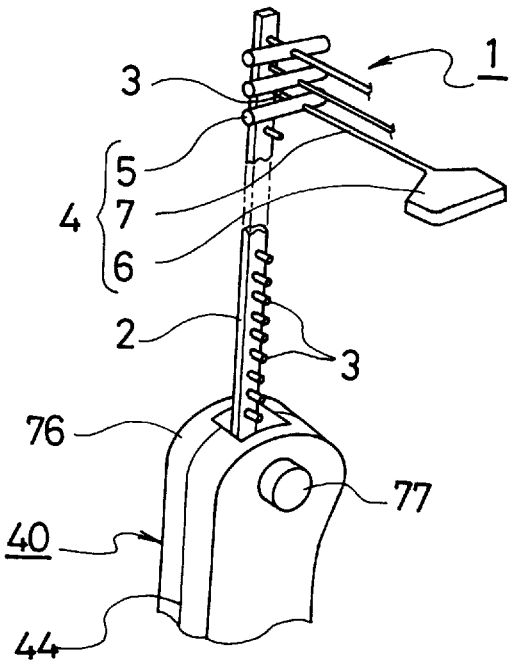
FIG. 9 is an enlarged perspective view of a connecting-rod guide.

As shown in FIG. 1, a cylindrical connecting-rod guide 40 is removably journaled to an exit 75 of the guide groove 14. The connecting-rod guide 40 is journaled to the exit 75 of the guide groove 14 by a shaft 77 set to the both sides of the head 76 of the guide 40. Moreover, the connecting-rod guide 40 has a male connective portion 43 at the front end of a leg 42 provided for a rear margin 78 of the guide 40. The connective portion 43 is removably set to a female connective portion 79 at the bottom of the trigger 64. Moreover, as shown in FIG. 9, the connecting-rod guide 40 has a longitudinal crack 44 at its front.

Therefore, when the connecting rod 2 coming out of the guide groove 14 of the tag attaching apparatus 10 into the connecting-rod guide 40 is stuck at the middle of the connecting-rod guide 40, it is possible to remove the connecting rod 2 outward from the crack 44 of the connecting-rod guide 40.

It is preferable to form the connecting-rod guide 40 with a synthetic resin softer than the synthetic resin forming the tag attaching apparatus body 11. Moreover, it is preferable to form the connecting-rod guide 40 with a transparent or translucent resin so that the inside of the guide 40 can be seen.

Figure 10:
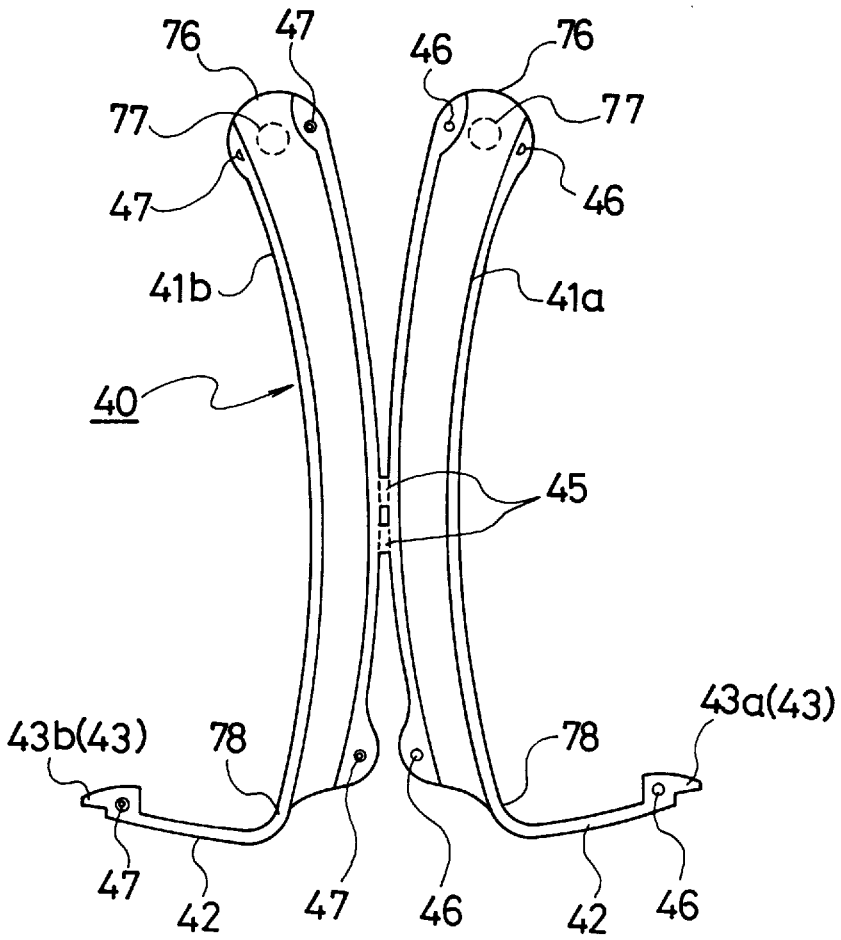
FIG. 10 is a development of a connecting-rod guide.

FIG. 10 is a development of the connecting-rod guide 40, in which right and left barrels 41*a* and 41*b* are connected by a hinge 45. Moreover, when putting the both barrels together, protrusions 47 formed on the barrel 41*b* and a connective portion 43*b* are fitted into and integrated with holes 46 formed in the barrel 41*a* and a connective portion 43*a*. Though not specified, it is preferable to form the connecting-rod guide 40 to be prismatic, compressed cylindrical, or cylindrical. Moreover, it is possible to omit the crack 44 and hinge 45.

Figure 11:
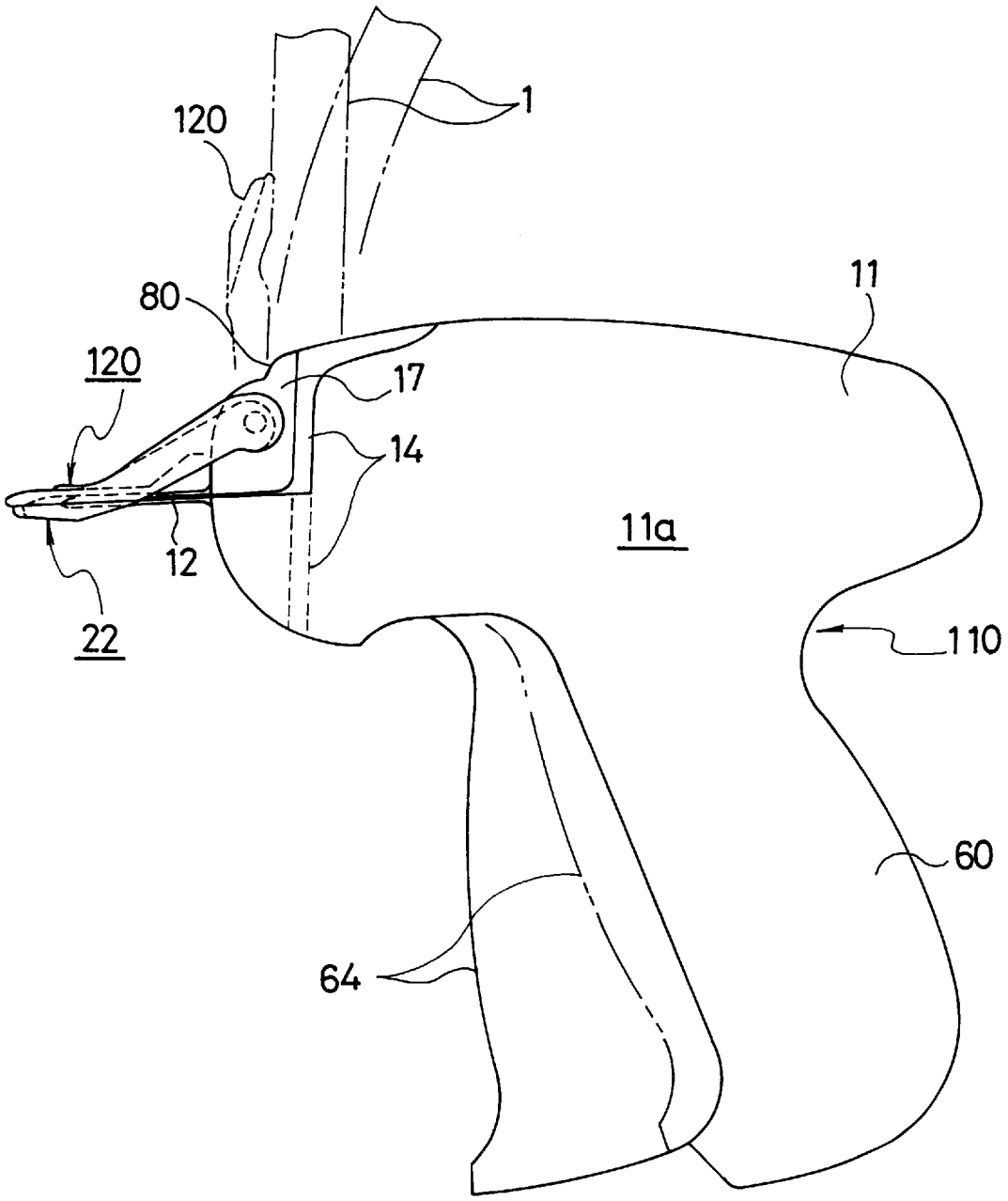
FIG. 11 is a side view showing another embodiment of a tag attaching apparatus of the present invention.
Figure 15:
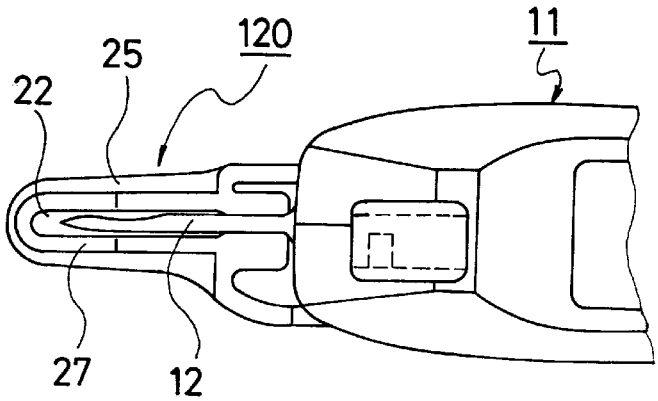
FIG. 15 is an enlarged bottom view of an essential portion of a tag attaching apparatus of the present invention.
Figure 16:
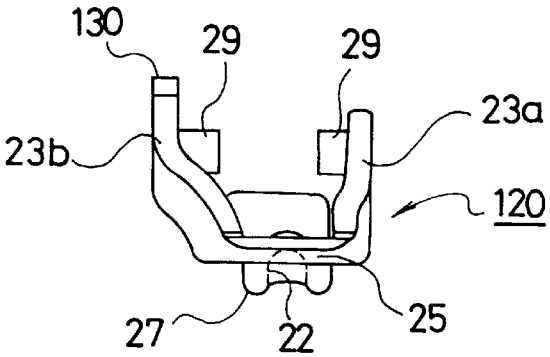
FIG. 16 is a front view of a needle cover.

FIG. 11 shows another embodiment of a tag attaching apparatus of the present invention. In the case of the tag attaching apparatus 110, a needle cover 120 is journaled to the head 17 of a body 11 so that the cover 120 can be vertically pivoted similarly to the case of the above embodiment. The needle cover 120 has a hollow needle storage groove 22 for storing a hollow needle 12 at its front. The hollow needle storage groove 22, as shown in FIG. 15, is formed with a U-shaped side wall 27 provided for the front of a partition 25.

Though the length of the needle cover 120 depends on the length of the hollow needle 12, any length is accepted as long as the length allows the hollow needle 12 to be stored. The depth of the hollow needle storage groove 12 is enough when the depth is almost equal to the diameter of the hollow needle 12. However, from the viewpoint of the safety, it is preferable that the depth is approx. 1.5 to 2 times larger than the diameter of the hollow needle 12.

Figure 12:
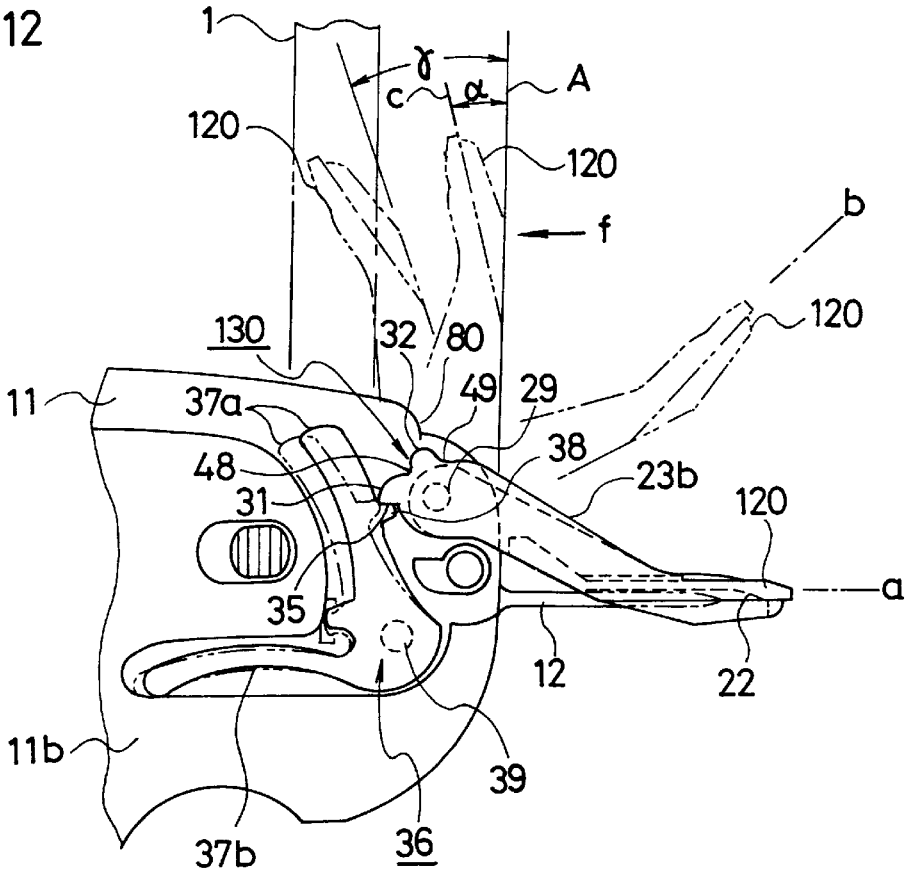
FIG. 12 is an illustration for explaining operations of a needle cover.

As shown in FIG. 12, the needle cover 120 has a ratchet wheel 130 coaxial with a shaft 29 at its one arm 23*b*. Moreover, a stopper 36 engaging with the ratchet wheel 130 is journaled to the side face 11*b* of the body 11. The stopper 36 is forked and an arm 37*a* at the side facing the ratchet wheel 130 is provided with a claw 38 engaging with the ratchet wheel 130. Furthermore, the other arm 37*b* is curved upward so as to have a spring force. Furthermore, a shaft 39 to be set to the body 11 is provided for the joint between the two arms 37*a* and 37*b*.

Figure 13:
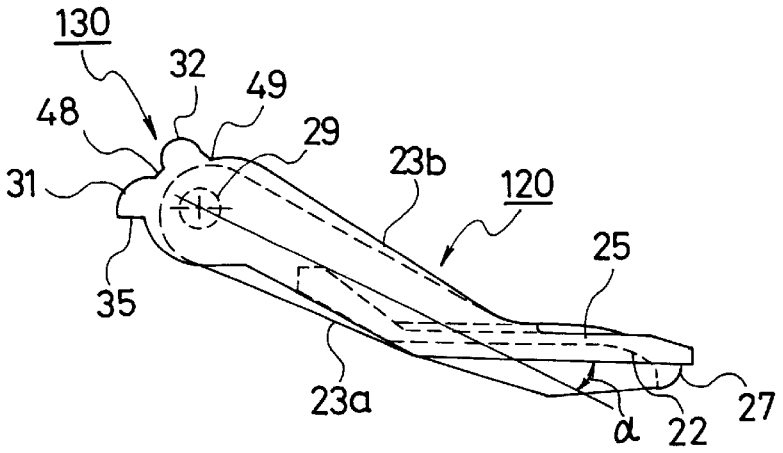
FIG. 13 is a side view of a needle cover.
Figure 14:
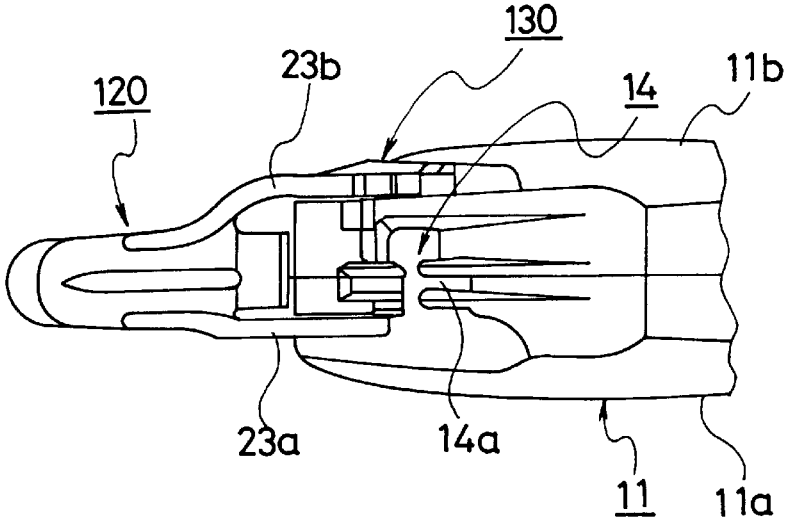
FIG. 14 is an enlarged top view of a tag attaching apparatus of the present invention.

As shown in FIG. 13, the ratchet wheel 130 is provided with first and second claws 31 and 32. Moreover, a first groove 48 is formed between the first and second claws 31 and 32 and a second groove 49 is formed between the second claw 32 and a leg 23*b*. Furthermore, the first claw 31 has a notched portion 35 parallel with a partition 25 at on its one side, that is, at the partition 25 side of the needle cover 120. The arm 23*b* is set to the partition 25 at a predetermined angle $\alpha$. For other parts, the same parts are provided with the same symbol and their detailed description is omitted.

Thus, as shown in FIG. 12, by turning the needle cover 120 to a horizontal position "a", the hollow needle 12 set to the front end of the body 11 is stored in the hollow needle storage groove 22 provided for the front of the needle cover 120. In this case, the claw 38 of the stopper 36 engages with the notched portion 35 of the ratchet wheel 130 to prevent the needle cover 120 from rotating.

When inserting the tag pin group 1 into the guide groove 14 of the tag attaching apparatus 110 or removing the tag pin group 1 from the tag attaching apparatus 110, the needle cover 120 is rotated to the position of symbol "b". In this case, the arm 37*a* of the stopper 36 is retracted from the position shown by a solid line to the position shown by a two-dot-chain line and the claw 38 of the stopper 36 is removed from the notched portion 35 of the ratchet wheel 130 to rotate the needle cover 120 to the position of symbol "b". When the claw 38 of the stopper 36 engages with the first groove 48 of the ratchet wheel 130, the needle cover 120 is set to the position of symbol "b".

After setting the tag pin group 1 to the guide groove 14 of the tag attaching apparatus 110, the needle cover 120 is rotated to the position of symbol "c". Then, as shown in FIG. 12, the needle cover 120 confronts the tag pin group 1 and thereby, it is possible to prevent the tag pin group 1 from contacting a commodity. In this case, the claw 38 of the stopper 36 engages with the groove 49 of the ratchet wheel 130.

In the case of this embodiment, a commodity is not damaged because the needle cover 120 has a play $\gamma$. That is, when the needle cover 120 is pressed as shown by the arrow "f", the arm 37*a* of the stopper 36 retreats as shown by a two-dot-chain line, and the needle cover 120 tilts by an angle $\gamma$ from the vertical plane A vertical to the hollow needle 12. However, when a force working on the needle cover 120 is lost, the needle cover 120 is returned to the position of the vertical plane A due to the spring force of the stopper 36. Moreover, the body 11 has a lump-like protrusion 80 at the top of its front end to prevent the needle cover 120 from tilting up to a play angle or more.

When rotating the needle cover 120 from the position to symbol "b" to the position of symbol "c" or from the position of symbol "c" to the position of symbol "b" or "a", the cover 120 can be easily rotated only by rotating it counterclockwise or clockwise because the shape of the ratchet wheel 130 is smooth. Moreover, it is preferable to set the angle $\alpha$ in a range of approx. 5° to 10°.

What is claimed is:

1. A tag attaching apparatus including a hollow needle having an expanding slot formed from the front end to the rear end of said needle at its side face in the body of said tag attaching apparatus, wherein a needle cover having a groove for storing said hollow needle at its front and a groove for supporting a tag pin group inserted into a tag pin group guide groove at its back is set to the head of said tag attaching apparatus body enclosed by a transverse groove provided for said tag attaching apparatus body so as to communicate with said expanding slot and said tag pin group guide groove provided for said tag attaching apparatus body so as to intersect said transverse groove so that the needle cover can be vertically pivoted.

2. The tag attaching apparatus according to claim 1, wherein a needle cover has an arm diagonally set to a partition present between a groove for storing a hollow needle and a groove for supporting a tag pin group and a ratchet wheel coaxial with the rotation center of said needle cover and a stopper engaging with said ratchet wheel is journaled to said tag attaching apparatus body.

3. The tag attaching apparatus according to claim 2, wherein a ratchet wheel has a first claw for supporting a needle cover at a hollow needle storing position, a second groove for supporting said needle cover so as to be kept upright, and a third groove for supporting said needle cover so as to be tilted toward the rear of a body from the upright position.

4. The tag attaching apparatus according to claim 2, wherein a stopper has a claw urged toward a ratchet wheel.

5. The tag attaching apparatus according to claim 1, wherein a tag pin group guide groove is provided with a cylindrical connecting-rod guide for guiding a connecting rod to the exit.

6. A tag attaching apparatus including a hollow needle having an expanding slot formed from the front end to the rear end of said needle at its side face in the body of said tag attaching apparatus, wherein a needle cover having a groove for storing said hollow needle at its front is set to the head of said tag attaching apparatus body enclosed by a transverse groove provided for said tag attaching apparatus body so as to communicate with said expanding slot and a tag pin group guide groove provided for said tag attaching apparatus body so as to intersect said transverse groove so that the needle cover can be vertically pivoted.

7. The tag attaching apparatus according to claim 6, wherein a needle cover has an arm diagonally set to a partition located at the back of a groove for storing a hollow needle and a ratchet wheel coaxial with the rotation center of said needle cover and a stopper engaging with said ratchet wheel is journaled to the body of said tag attaching apparatus.

8. The tag attaching apparatus according to claim 7, wherein a ratchet wheel has a first claw for supporting a needle cover at a hollow needle storing position and a second groove for supporting said needle cover so as to be kept upright.

9. The tag attaching apparatus according to claim 7, wherein a stopper has a claw urged toward a ratchet wheel.

* * * * *